US010281093B2

(12) United States Patent
Berends et al.

(10) Patent No.: US 10,281,093 B2
(45) Date of Patent: May 7, 2019

(54) WORK LIGHT ASSEMBLY

(71) Applicant: Ningbo QTOP Import & Export Co., Ltd., Ningbo (CN)

(72) Inventors: Boyd Edward Berends, Zeeland, MI (US); Bob Andrew Johnson, III, Holland, MI (US)

(73) Assignee: NINGBO QTOP IMPORT & EXPORT CO., LTD (CN)

( * ) Notice: Subject to any disclaimer, the term of this patent is extended or adjusted under 35 U.S.C. 154(b) by 0 days.

(21) Appl. No.: 15/192,061

(22) Filed: Jun. 24, 2016

(65) Prior Publication Data

US 2017/0370536 A1 Dec. 28, 2017

(51) Int. Cl.

| | |
|---|---|
| ***F21V 15/02*** | (2006.01) |
| ***F21L 4/02*** | (2006.01) |
| ***F21V 21/08*** | (2006.01) |
| ***F21V 21/096*** | (2006.01) |
| *F21Y 115/10* | (2016.01) |
| *F21W 131/402* | (2006.01) |

(52) U.S. Cl.

CPC ..... *F21L 4/02* (2013.01); *F21V 15/02* (2013.01); *F21V 21/0832* (2013.01); *F21V 21/0965* (2013.01); *F21W 2131/402* (2013.01); *F21Y 2115/10* (2016.08)

(58) Field of Classification Search

CPC ..... F21L 4/08; F21V 15/01; F21V 21/0885; F21V 21/0965; F21V 21/406; F21V 23/0414; F21Y 2115/10; H02J 7/0044; Y10S 362/80

USPC ..... 362/249.05

See application file for complete search history.

(56) References Cited

U.S. PATENT DOCUMENTS

| | | | | |
|---|---|---|---|---|
| D391,655 | S * | 3/1998 | Hughes | D26/37 |
| 7,234,833 | B2 * | 6/2007 | Hatherill | F21L 4/08 362/191 |
| 7,325,944 | B2 * | 2/2008 | Kovacik | F21L 4/08 362/196 |
| 7,553,051 | B2 * | 6/2009 | Brass | F21L 4/00 362/311.01 |
| 8,562,184 | B2 * | 10/2013 | Klipstein | F21L 14/023 362/249.02 |

(Continued)

*Primary Examiner* — Seung H Lee

(74) *Attorney, Agent, or Firm* — The Watson IP Group, PLC; Jovan N. Jovanovic

(57) ABSTRACT

A work light assembly comprising a housing, and an outer shield. The housing has a handle portion and an illuminating portion, separated by a neck portion. The handle portion has an outer surface and an inner bore extending between an upper and a lower end thereof. The inner bore opening is at the lower end, and has a bore cover threadedly engaged so as to cover the inner bore. The illuminating portion has a proximal end at the neck portion and a distal end extending therefrom. An outward face that is generally perpendicular to an axis of the handle portion is provided, with a plurality of LED elements positioned thereon. A battery is positioned within the inner bore and coupled to a switch mounted on the handle portion. The battery is also coupled to the plurality of LED elements in electrical communication, so as to be cordless. The outer shield is coupled to the neck portion of the handle portion. The outer shield extends around at least a portion of the illuminating portion.

11 Claims, 8 Drawing Sheets

(56) References Cited

U.S. PATENT DOCUMENTS

| | | | | |
|---|---|---|---|---|
| 9,746,143 | B2 * | 8/2017 | Osburn | F21L 14/02 |
| 2016/0356439 | A1 * | 12/2016 | Inskeep | H02J 7/0052 |

* cited by examiner

WORK LIGHT ASSEMBLY

CROSS-REFERENCE TO RELATED APPLICATION

N/A

BACKGROUND OF THE DISCLOSURE

1. Field of the Disclosure

The disclosure relates in general to lighting, and more particularly, to a work light assembly that can be utilized in a cordless fashion.

2. Background Art

The use of work lights is known in the art. Many different work lights are presented. Drawbacks are known from these different work lights. For example, some such lights provide poor illumination. Others generate an abundance of heat and are difficult to operate. Still others require a cord and an outlet thereby limiting their usability in many different circumstances.

Therefore, there is a need for a cordless work light assembly that overcomes the deficiencies of the prior art.

SUMMARY OF THE DISCLOSURE

The disclosure is directed to a work light assembly comprising a housing, and an outer shield. The housing has a handle portion and an illuminating portion, separated by a neck portion. The handle portion has an outer surface and an inner bore extending between an upper and a lower end thereof. The inner bore opening is at the lower end, and has a bore cover threadedly engaged so as to cover the inner bore. The illuminating portion has a proximal end at the neck portion and a distal end extending therefrom. An outward face that is generally perpendicular to an axis of the handle portion is provided, with a plurality of LED elements positioned thereon. A battery is positioned within the inner bore and coupled to a switch mounted on the handle portion. The battery is also coupled to the plurality of LED elements in electrical communication, so as to be cordless. The outer shield is coupled to the neck portion of the handle portion. The outer shield extends around at least a portion of the illuminating portion.

In some configurations, the bore cover includes a lower surface, and a magnet is coupled to the lower surface.

In some configurations, the handle portion further includes a base leg having a lower ledge surface.

In some configurations, the lower ledge surface is substantially parallel to a plane defined by the outward face.

In some configurations, the outer shield includes a flat portion. The flat portion of the outer shield defines a plane that is coplanar with the lower ledge surface.

In some configurations, the flat portion of the outer shell includes a magnet positioned thereon.

In some configurations, the outer shield includes a front edge. The front edge defines a plane that is one of parallel to and coplanar with a plane defined by the outward face.

In some configurations, a hook member is positioned on the outer shield that extends away from the handle portion and the illuminating portion.

In some configurations, the hook member has an axis about which the hook member can be rotated.

In some configurations, the handle portion is substantially cylindrical.

BRIEF DESCRIPTION OF THE DRAWINGS

The disclosure will now be described with reference to the drawings wherein.

DETAILED DESCRIPTION OF THE DISCLOSURE

Figure 1:
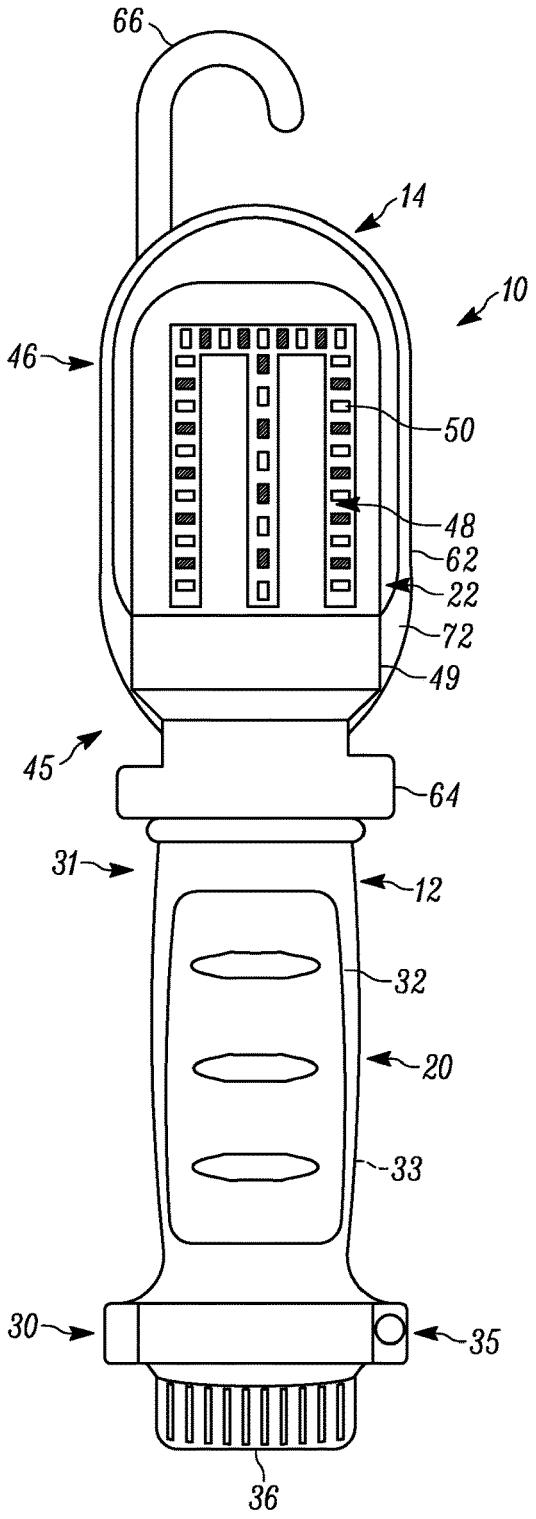
FIG. 1 of the drawings is a front elevational view of the work light assembly of the present disclosure.
Figure 2:
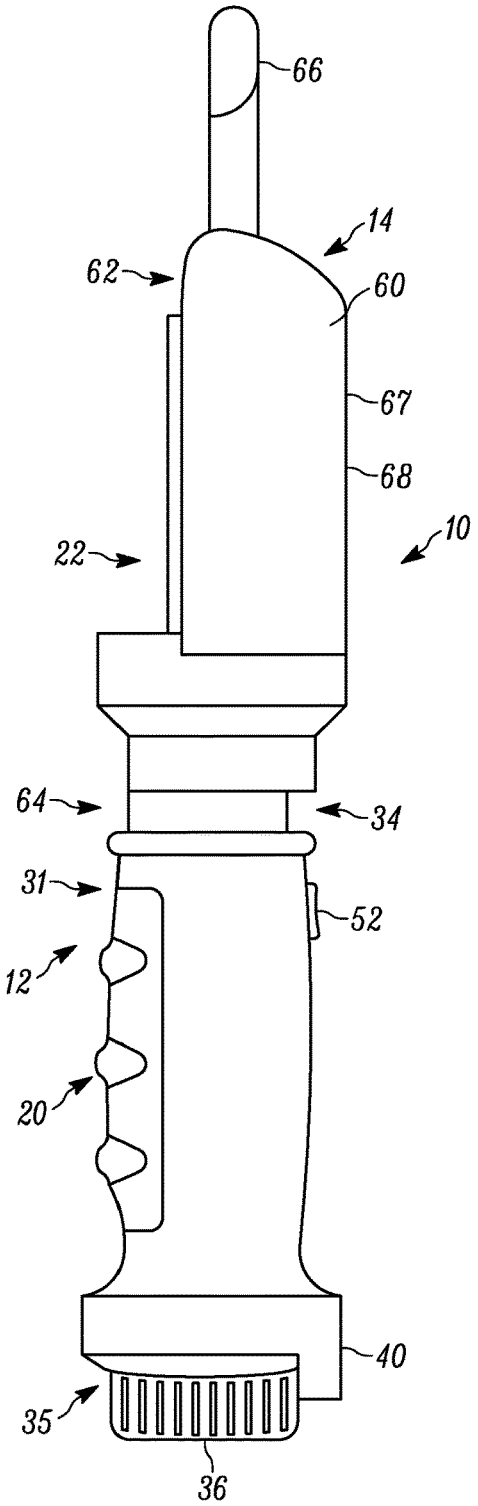
FIG. 2 of the drawings is a side elevational view of the work light assembly of the present disclosure.
Figure 3:
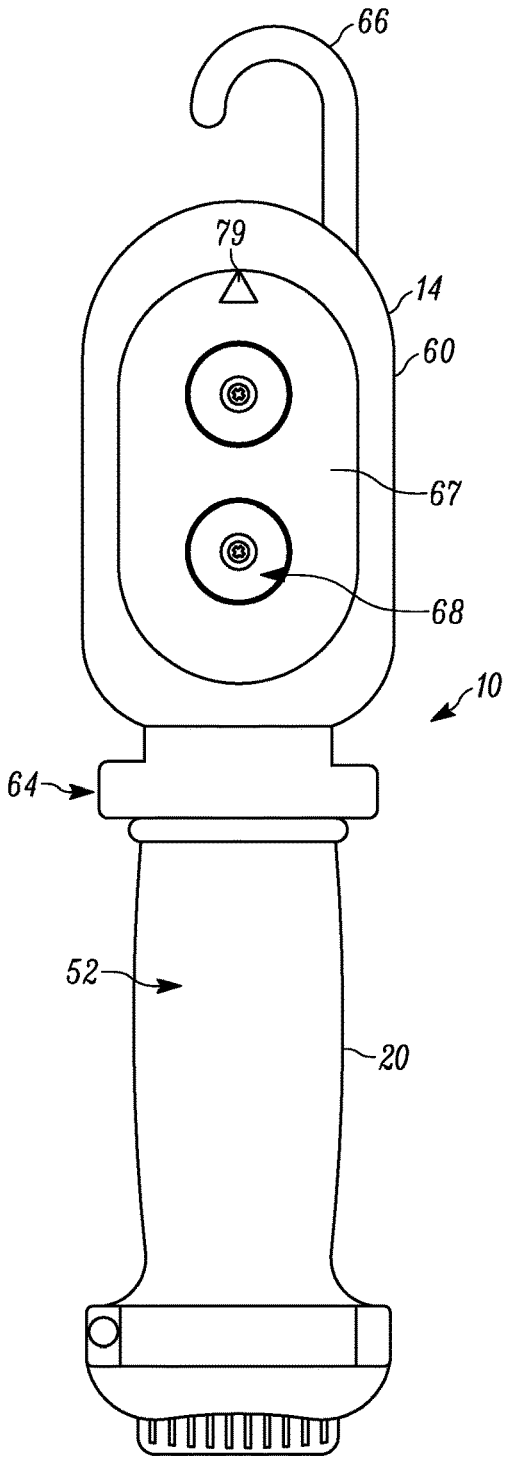
FIG. 3 of the drawings is a back plan view of the work light assembly of the present disclosure.
Figure 4:
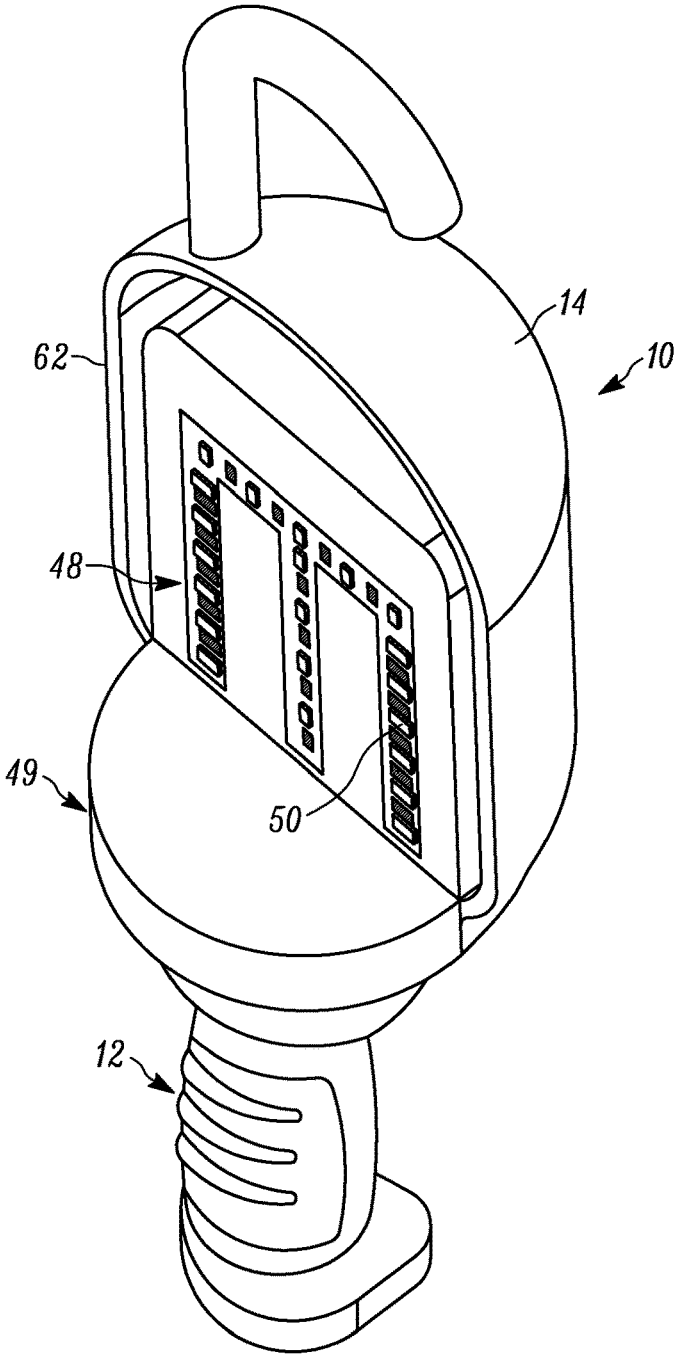
FIG. 4 of the drawings is a perspective view of the work light assembly of the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIGS. 1 through 6, the work light assembly is shown generally at 10. The work light assembly includes housing 12 and outer shield 14. The work light assembly is configured to mimic the appearance of a traditional work light, while offering enhancements and wireless capabilities. In addition, the unique construction maintains the appearance while offering operational and structural enhancements.

The housing 12 includes handle portion 20 and illuminating portion 22. Preferably, the housing 12 is formed from two "case halves" that divide the housing into two elongated structures that have a generally semi-circular cross-sectional configuration. The handle portion is generally elongated so as to allow for the gripping of the work light assembly by a user. The handle portion 20 extends from lower end 30 to upper end 31. A neck portion 34 is disposed at the upper end (which may be configured to receive the outer shield 14, for coupling therewith).

The handle portion includes on outer surface 32 and an inner bore 33. The outer surface includes contoured portions that are structurally configured to receive or guide the fingers of the user. In the configuration shown, the upper portion of the handle portion includes an insert region that has three peaks that extend transversely thereacross. The switch 52 can be positioned on the back surface of the handle portion. In the configuration shown, the switch is a three position switch, namely, an off position in the middle with on positions on either side (of different intensities). The position of the switch is such that the index finger of the user or the thumb of the user can manipulate the switch while holding onto the light in an operational configuration.

Figure 5:
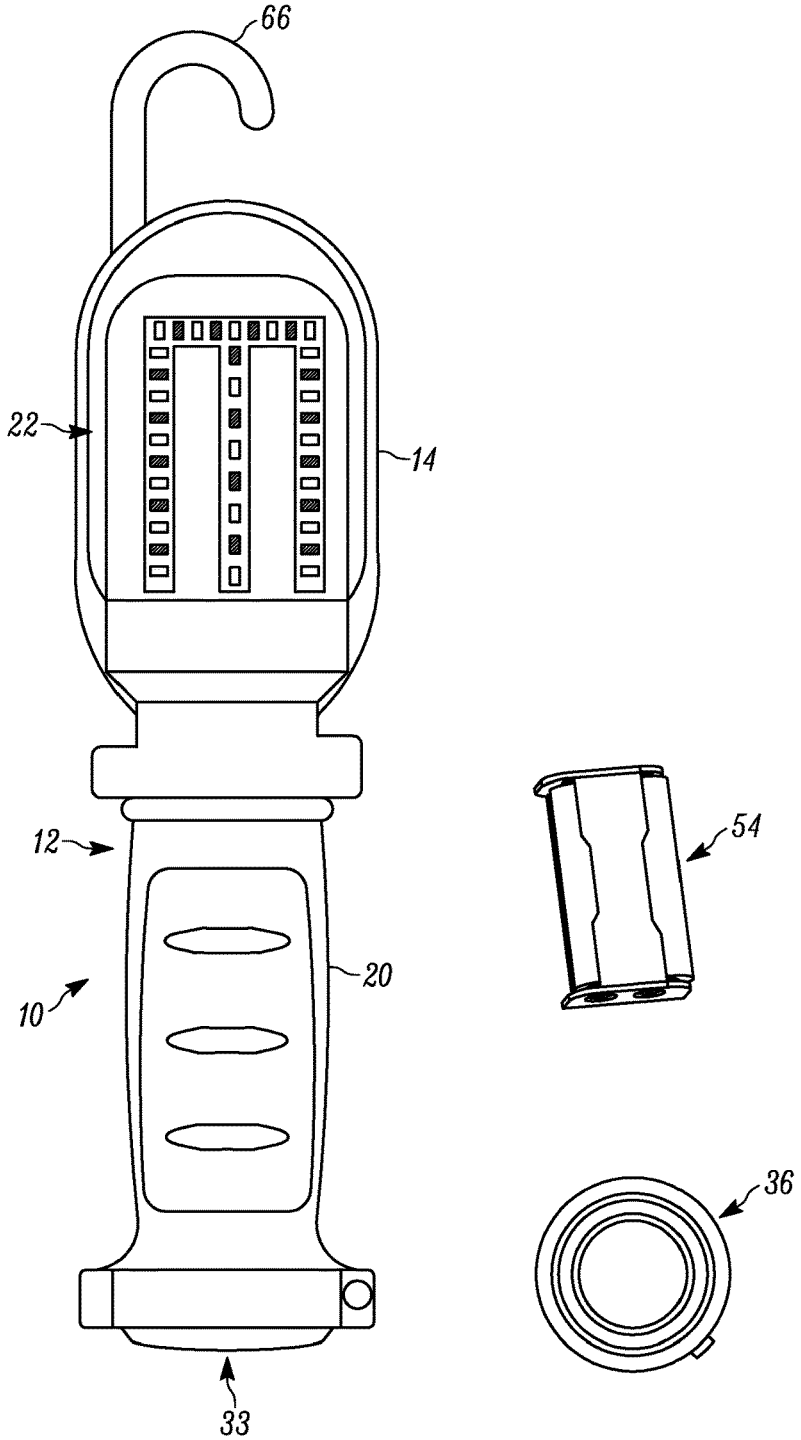
FIG. 5 of the drawings is an exploded view of the work light assembly of the present disclosure, showing, in particular, the battery and the frame containing the battery, along with the bore cover removed.
Figure 6:
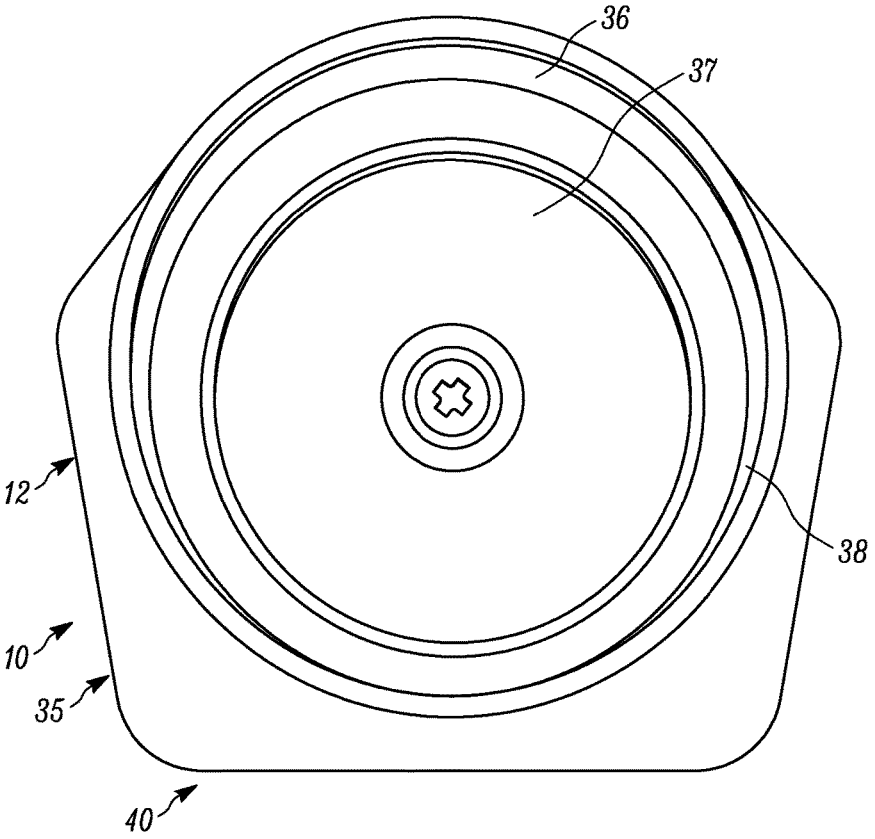
FIG. 6 of the drawings is a bottom plan view of the work light assembly of the present disclosure, showing, in particular, the magnet on the bore cover.

With reference to FIG. 5, the inner bore 33 is configured to receive a plurality of batteries 54 to power the LED elements 50 (that will be discussed below). Additionally, the inner bore provides adequate room for other electronic components and wiring.

At the lower end of 30 of the handle portion 20 includes base leg 35. The base leg 35 allows for the laying of the work light assembly onto an outside surface without allowing the same to roll around. Additionally, the base leg is configured so that the light is directed in an upward direction (or another predetermined direction). The base leg 35 includes lower ledge surface 40 which contacts the outside surface.

The bore cover 36 provides a cover to the inner bore to provide closure thereto. In the configuration shown, the bore cover can form the housing for a battery pack, or may form a portion of the battery pack. The bore cover may be threaded onto the lower end of the inner bore, and may include a grasping outer face (in this case, an outer cylindrical configuration having knurls displaced along the outer surface thereof). Additionally, the bore cover may include a lower surface. The lower surface may comprise a magnetic material so as to be releasably attachable to an outer ferromagnetic surface. Generally, the bore cover has a substantially cylindrical configuration.

The illuminating portion 22 includes proximal end 45, distal end 46 and outward face 48. The proximal end 45 includes bulge region which extends from neck portion 34 of the upper end of the handle portion 20. The illuminating portion 22 includes outward face 48 which is positioned so as to direct light in a direction that is outward and perpendicular to a longitudinal axis of the housing 12. Additionally, the outward face 48 defines a plane, preferably, that is substantially parallel to the plane created by the lower ledge surface 40 of the base leg 35 of the handle portion 20.

A plurality of LED elements is disposed along the outward face 48, in this case, in a block-like "M" pattern. Of course, other configurations are contemplated, including random positions. Additionally, while the outward face 48 is shown as being substantially planar, other slightly convex or concave structures are contemplated as well. Additionally, in some configurations, the outward face may be configured to be rotatable about an axis that is generally central and parallel thereto. As such, the outward face (and the LED's) can be rotated side to side in some configurations. In other configurations, the outward face may be fixed.

It will be understood that the LED elements are coupled to the switch 52 and to the battery within the inner bore. Thus, when the switch is actuated, electrical flow is directed from the batteries to the LED's.

The outer shield 14 is shown as comprising outer surface 60, front edge 62, neck coupling member 64 and hook member 66. The outer shield is configured to extend about the back portion of the illuminating portion. The outer shield has a substantially hemispherical configuration, with the neck coupling member extending about the neck portion 34 of the handle portion 20. In some configurations, the neck coupling member may include a snap member which positively locks the neck coupling member in an encircling manner about the neck portion. In other configurations, a clamp may include a fastener or the like so as to clamp the neck coupling member about the neck portion. It will be understood that in other configurations, the neck portion may be integrally formed with the illuminating portion, or may comprise a press-fit component that is coupled in multiple different manners to the housing 12. In some configurations, the outer shield may have a flat region that is substantially coplanar with the lower ledge surface of the base leg, so that the work light assembly can rest on these two surfaces in a generally planar manner and in a stable manner. The outer shield may include magnets on the back 67 so as to enable coupling to outside surfaces. Additionally, an opening (in this case a triangular-like opening) 79 may be presented on the back so as to enable the coupling with a hook or the like on a wall or a suspended hook or other member which can be extended therethrough.

Figure 7:
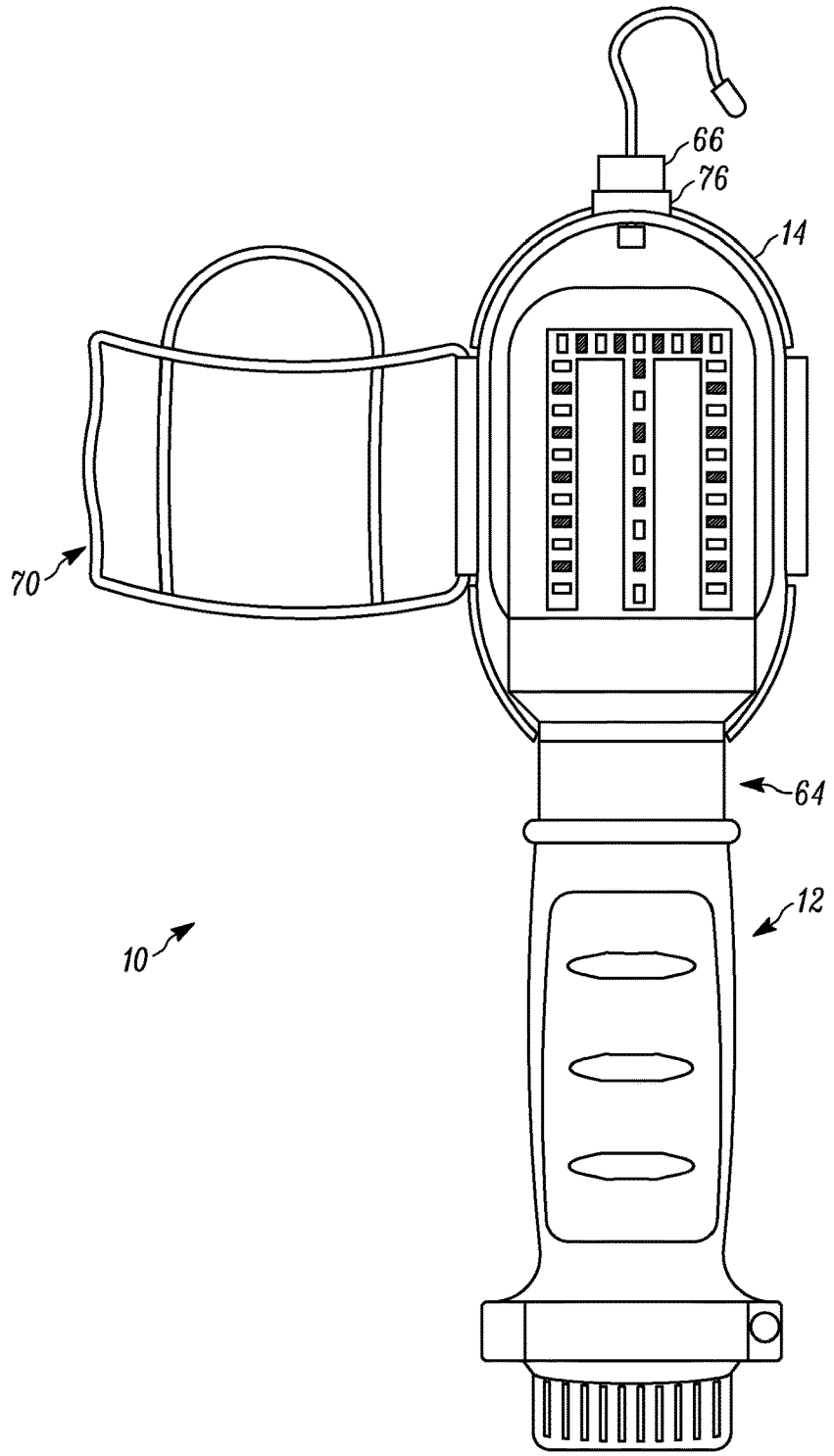
FIG. 7 of the drawings is a top plan view of the work light assembly of the present disclosure, showing, in particular, the front shield in a rotated position, away from covering the illuminating portion of the housing.

The outer shield terminates about the front edge 62 which generally forms a plane that is one of coplanar and generally parallel to the plane created by the outward face 48, so as to provide a frame therearound. Thus, the outer shield has a generally convex configuration forming cavity 72. In some configurations, a front shield, such as front shield 70 (FIG. 7). The front shield can be integrally formed with the outer shield or can be rotatably coupled thereto so as to allow the front shield to be rotated away from being in front of the outward face.

Figure 8:
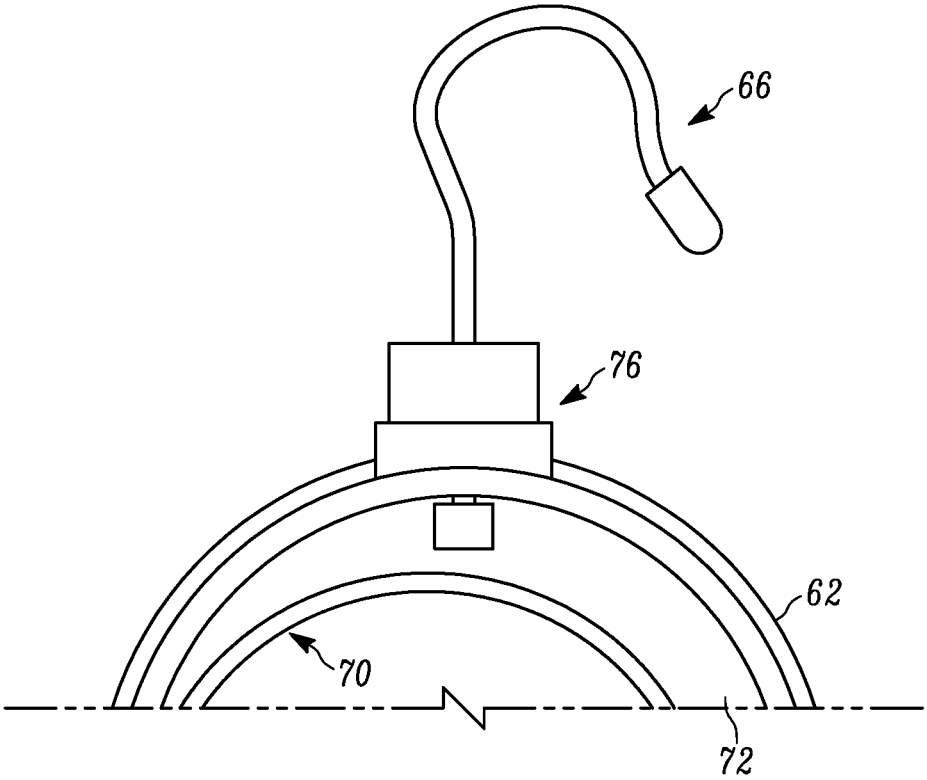
FIG. 8 of the drawings is a top plan view of the hook member of the outer shield of the present disclosure, showing, in particular, the articulating joint associated with the same.

The hook member 66 is shown in FIG. 1 as comprising a molded member that may be integrally formed with the outer shield at the top end thereof In other configurations, the hook member may comprise a separate member that is fixedly coupled to the outer shield, or that may be rotatably coupled to the outer shield (see, FIGS. 7 and 8). That is, the hook may rotate about an axis that extends generally longitudinally through the housing 12.

Advantageously, the work light assembly of the present configuration may utilize rechargeable or non-rechargeable batteries. Additionally, the work light assembly is configured for use without any cords or the like, and through the magnets positioned on the bore cover and the outer shield, the work light may be coupled to an outside ferromagnetic structure. Additionally, the different configurations disclosed herein may be utilized in various combinations, and, it will be understood that the familiar style, with a substantially different configuration. For example, the cordless nature of the device with the additional utility is a combination that provides enhanced utility thereto.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A work light assembly comprising:

a housing having a handle portion and an illuminating portion, separated by a neck portion, the handle portion having an outer surface and an inner bore extending between an upper and a lower end thereof, the inner bore opening at the lower end, with a bore cover threadedly engaged so as to cover the inner bore;

the illuminating portion having a proximal end at the neck portion and a distal end extending therefrom, with an outward face that is generally substantially planar and perpendicular to an axis of the handle portion, with a plurality of LED elements positioned thereon, and having a back portion opposite the outward face;

a battery positioned within the inner bore and coupled to a switch mounted on the handle portion, which is coupled to the plurality of LED elements in electrical communication, so as to be cordless; and an outer shield coupled to the neck portion of the handle portion and extending upwardly therefrom, the outer shield extending around at least a portion of the illuminating portion behind the outward face of the illuminating portion, the portion extending behind the outward face comprising a substantially hemispherical member, with the back portion positioned within the cavity formed by the substantially hemispherical member, and spaced apart therefrom, wherein the outer shield further includes a front shield that is rotatably coupled to a side edge of the substantially hemispherical portion, and positionable so as to extend across the illumination portion, and to be releasably coupled to the substantially hemispherical portion on a side opposite the illumination portion.

2. The work light assembly of claim 1 wherein the bore cover includes a lower surface, and a magnet is coupled to the lower surface.

3. The work light assembly of claim 1 wherein the handle portion further includes a base leg having a lower ledge surface extending outwardly therefrom.

4. The work light assembly of claim 3 wherein the lower ledge surface is substantially parallel to a plane defined by the outward face.

5. The work light assembly of claim 4 wherein the outer shield includes a flat portion, the flat portion of the outer shield defines a plane that is coplanar with the lower ledge surface, such that when positioned on an outside surface, solely the flat portion and the lower edge surface contact the outside surface.

6. The work light assembly of claim 5 wherein the flat portion of the outer shell includes a magnet positioned thereon.

7. The work light assembly of claim 1 wherein the outer shield includes a front edge, the front edge defining a plane that is one of parallel to and coplanar with a plane defined by the outward face.

8. The work light assembly of claim 7 wherein a hook member is positioned on the hemispherical portion of the outer shield that extends away from the handle portion and the illuminating portion.

9. The work light assembly of claim 8 wherein the hook member has an axis about which the hook member can be rotated.

10. The work light assembly of claim 1 wherein the handle portion is substantially cylindrical.

11. The work light assembly of claim 1, wherein the front shield has a outwardly convex configuration formed from a plurality of frame members.

* * * * *